United States Patent [19]

Caldwell

[11] Patent Number: 4,916,782

[45] Date of Patent: Apr. 17, 1990

[54] METHOD FOR MAKING A NON-WOVEN FLANNEL FABRIC

[75] Inventor: Kenneth G. Caldwell, Maytown, Pa.

[73] Assignee: Armstrong World Industries, Inc., Lancaster, Pa.

[21] Appl. No.: 302,445

[22] Filed: Jan. 27, 1989

Related U.S. Application Data

[62] Division of Ser. No. 133,124, Dec. 14, 1987, Pat. No. 4,828,914.

[51] Int. Cl.[4] ..... D04H 18/00

[52] U.S. Cl. ..... 28/111; 28/109; 28/112; 156/148; 428/88; 428/92; 428/96; 428/113

[58] Field of Search ..... 28/109, 111, 112

[56] References Cited

U.S. PATENT DOCUMENTS

| | | | |
|---|---|---|---|
| 2,158,533 | 5/1939 | Cavey | 28/112 X |
| 3,364,543 | 1/1968 | Homier et al. | 28/112 |
| 3,528,147 | 9/1970 | Fior et al. | 28/112 |
| 3,570,085 | 3/1971 | Heinemann | 28/112 |
| 3,849,223 | 11/1974 | Kent | 28/109 X |
| 4,144,366 | 3/1979 | Lewis | 28/109 X |
| 4,199,640 | 4/1980 | Goldman | 28/109 X |

FOREIGN PATENT DOCUMENTS

| | | | |
|---|---|---|---|
| 17322 | 9/1934 | Australia | 28/109 |
| 1040598 | 9/1966 | United Kingdom | 28/109 |

*Primary Examiner*—Werner H. Schroeder
*Assistant Examiner*—Bradley K. DeSandro

[57] ABSTRACT

A method and apparatus is set forth to form a flannel-like product. A non-woven web of fibers of two contrasting shades of color are needled twice to form a non-woven fabric with the coloration of woven flannel material. A calendar roll smooths the fabric to remove the appearance of the needling operations and get a non-woven flannel-like product.

4 Claims, 1 Drawing Sheet

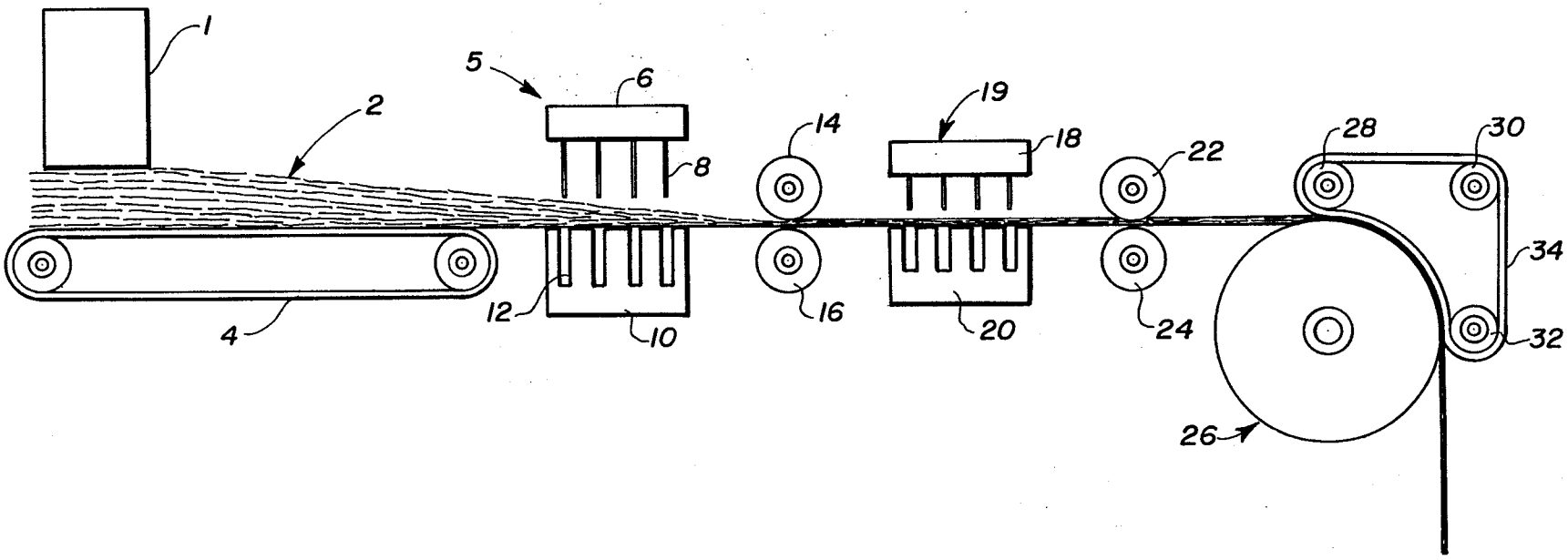
1
2
4
5
6
8
10
12
14
16
18
19
20
22
24
26
28
30
32
34

METHOD FOR MAKING A NON-WOVEN FLANNEL FABRIC

CROSS REFERENCE TO RELATED APPLICATION

This is a division of application Ser. No. 133,124, filed Dec. 14, 1987, now Pat. No. 4,828,914.

BACKGROUND OF THE INVENTION

1. Field of the Invention

The invention is directed to a method of making a non-woven flannel fabric and, particularly, to a needling technique for simulating a conventional woven flannel fabric by use of a non-woven fabric.

2. Description of the Prior Art

The concept of needle punching a non-woven fabric to form a mat is illustrated by the Kopplin U.S. Pat. No. 2,373,033 and the Buresh et al. U.S. Pat. No. 3,704,191.

The concept of needle punching a non-woven fabric to mingle fibers and provide an ornamental design of different colors is shown by Lochner in U.S. Pat. No. 3,755,055. In the Lochner patent, two layers of fabric of different colors are used. It is possible that a single color could be utilized, but two layers of fabric are still used.

There does not appear to be in the prior art the teaching of a single layer of non-woven fabric having a color blend in the single layer to provide, after needling, the desired simulation of a flannel fabric.

SUMMARY OF THE INVENTION

The invention is directed to a method of making a non-woven flannel fabric wherein a web of blended fibers of two colors is needled to lock together the plural fibers and to cause the fibers of different colors to form small distinct different colored spots on one surface of the web. Needling is carried out twice and then there is the ironing of one surface of the web to smooth the surface of the web and to eliminate the needle holes. The fibers used in the fabric are normally a polyester fiber and the needling is normally carried out with 200 to 400 needle penetrations per square inch. The calendar operation which irons one surface of the fabric is carried out on a roll with a temperature of 370°F. to 485°F.

An apparatus is used which has a conveying means for forming up plural layers of fiber of two colors to form the basic fabric. Means conveys the web through the two needling operations and a calendar roll irons the face of the fabric.

The result of using the above-described apparatus and method will result in the forming of a web of a non-woven polyester fabric of two contrasting shades of colors. The needle penetrations of about 300 per inch will entangle the fibers at each penetration and provide small distinct different color spots on one surface of the fabric in the matter of the mottled or variated coloration of woven flannel.

DESCRIPTION OF THE DRAWING

The figure of the drawing is a schematic showing of the apparatus for carrying out the method invention in the application.

DETAILED DESCRIPTION OF THE INVENTION

In the drawing, there is shown the apparatus for carrying out the claimed method in forming the claimed fabric. A means 1 deposits plural layers of fiber that have two colors of fiber non-uniformly blended therein to provide a web of a mottled two color effect. The web formed is shown as element 2 and it is carried on conveyor 4. A first needling means 5 which has an upper needle bar 6 and a lower bar 10 will be provided with 100 needles per linear inch. The needles are shown as element 8 and they do penetrate through the web 2 and partly into the apertures 12 of the lower bar 10. The needles are conventional in the art and have barbs thereon which are facing downward so that on the down stroke of the upper needle bar 6, the barbs entangle the fibers and force them from the top of the mat to the bottom of the mat in the direction of the lower bar 10. Upon the withdrawal upward of the upper needle bar 6, the needles slide out of the web without entangling the fibers of the web since the barbs slide across the fibers and do not entangle the fibers. The needling means is operated so that there are 300 needle penetrations per square inch of web to lock together the fibers of the web and cause the fibers of different color to form small distinct different colored spots on the lower surface of the web in the matter of the mottled or variated coloration which exists in conventional woven fabric material. Rolls 14 and 16 are draw rolls and pull the web through the first needling means 5.

A second needling means 19 is provided with an upper needle bar 18 and a lower bar 20 the same as the bars of the needling means 5. Draw rolls 22 and 24 pull the fabric through the needling means 19. Needling means 19 has the same construction, number of needles, and mode of operation as does needling means 5.

After the web has passed through the draw rolls 22 and 24, it moves towards a calendar means 26. In passing through the two needling means, the thickness of the fabric, which starts on conveyor 4, will have been reduced from about a 6-inch thickness as it rests on conveyor 4 to about a 3/16-inch thickness as it passes through draw rolls 22 and 24 and onto calendar roll 26.

Calendar roll 26 is heated to a surface temperature of 370°F. to 485°F. with a presser belt 34 passing around rolls 28, 30, and 32. The presser belt engages part of the surface, about 90%, of the calendar roll 26. The web 2 passes between the calendar roll 26 and the presser belt 34 to iron therebetween the lower surface of the web having the small distinct different color spots.

The claimed method of providing the blend of fibers, needling the fibers twice, and ironing the fabric is carried out by the apparatus above-described. The product formed is normally formed from polyester fibers of two contrasting shades of color. The web of non-woven flannel fabric has about 300 needle penetrations per inch with the fibers in the web entangled at each penetration. One surface of the web is smooth due to the ironing of calendar roll 26 and the appearance of the needle penetrations have been eliminated from this surface. The surface that is smooth is the surface towards which the fibers were entangled and pushed by the barbs of the needling means. The color of the fibers that appear on the smooth surface provides small distinct different color spots in the manner of the mottled or variated coloration of woven flannel.

What is claimed is:

1. The method of making a non-woven flannel fabric comprising the steps of:

a) providing a web of blended fibers of two shades of color of polyester fibers said web being formed of plural deposited layers of fibers that have the two colors of fiber non-uniformly blended, b) needling through the web of fibers to lock together the plural layers of fibers and cause the fibers of different colors to form small, distinct different color spots with holes on one surface of the web, c) needling the web of fibers a second time, and d) ironing the one surface of the web with the color spots to smooth the surface of the web and eliminate the needle holes in the surface.

2. The method of making a non-woven flannel fabric as set forth in claim 1 wherein:

a) the needling is carried out with the use of 200 to 400 needle penetrations per square inch.

3. The method of making a non-woven flannel fabric as set forth in claim 1 wherein:

a) the ironing is carried out on a calendar roll with a surface temperature of 370°F. to 485°F. and the web is pressed against and contacts at least 90% of the circumference of the calendar roll.

4. The method of making a non-woven flannel fabric as set forth in claim 1 wherein:

a) the surface with the color spots is the surface opposite from the surface into which the needles enter.

* * * * *